United States Patent [19]

Small, Jr. et al.

[11] 4,310,876

[45] Jan. 12, 1982

[54] LIGHTING FIXTURE AND METHOD USING MULTIPLE REFLECTIONS

[76] Inventors: Edward A. Small, Jr., 2255 E. Haven Dr., Santa Rosa, Calif. 95404; Ian Lewin, 11408 St. Andrews Way, Scottsdale, Ariz. 85254

[21] Appl. No.: 131,071

[22] Filed: Mar. 17, 1980

Related U.S. Application Data

[63] Continuation of Ser. No. 920,725, Jun. 30, 1978, abandoned.

[51] Int. Cl.[3] ..... F21V 7/00

[52] U.S. Cl. ..... 362/298; 362/217; 362/277; 362/301; 362/346

[58] Field of Search ..... 362/217, 255, 260, 263, 362/297, 298, 277, 301, 302, 303, 346, 347, 350; 350/166

[56] References Cited

U.S. PATENT DOCUMENTS

| | | | |
|---|---|---|---|
| 1,286,535 | 12/1918 | Cochran | 362/346 |
| 1,757,527 | 5/1930 | Henningsen | 362/346 |
| 2,149,109 | 2/1939 | Welch | 362/346 |
| 3,609,340 | 9/1971 | Habro | 362/346 |
| 3,634,675 | 1/1972 | Madsen | 362/303 |
| 3,651,320 | 3/1972 | Lasker | 362/303 |
| 3,836,767 | 9/1974 | Lasker | 362/303 |
| 4,037,096 | 7/1977 | Brendford | 362/298 |
| 4,112,483 | 9/1978 | Small | 362/298 |
| 4,135,231 | 1/1979 | Fisner | 362/297 |

*Primary Examiner*—Donald P. Walsh
*Attorney, Agent, or Firm*—Flehr, Hohbach, Test, Albritton & Herbert

[57] ABSTRACT

A lighting fixture and method using multiple reflections having a housing with an open side. A lamp is mounted in the housing and produces rays of light which pass through the open side. First and second reflecting surfaces are carried by the housing for reflecting light. The first and second reflecting surfaces are positioned on opposite sides of the lamp so that direct rays from the lamp will strike the first reflecting surface and be reflected onto the second reflecting surface and then will be reflected through the open side of the housing at a high angle with respect to the angle of the original direct rays from the lamp.

2 Claims, 7 Drawing Figures

LIGHTING FIXTURE AND METHOD USING MULTIPLE REFLECTIONS

This is a continuation, of application Ser. No. 920,725 filed June 30, 1978, now abandoned.

BACKGROUND OF THE INVENTION

In roadway and street lighting and lighting for parking lots, there is a need for lighting fixtures which have a large proportion of their light emanating therefrom at high angles. In addition, there is a requirement that they have high efficiency. Since lighting fixtures of this type are not available, there is a need to provide such lighting fixtures.

SUMMARY OF THE INVENTION AND OBJECTS

The lighting fixture and method which utilizes multiple reflections consists of a housing which has an open side. A lamp is mounted in the housing and produces rays of light. The first and second reflecting surfaces are carried by the housing for reflecting light from the lamp. The first and second reflecting surfaces are positioned on opposite sides of the lamp so that direct rays of the lamp which strike the first reflecting surface are reflected onto the second reflecting surface which reflects the rays through the open side at a high angle with respect to the angle of the direct rays from the lamp striking the first reflecting surface.

In general, it is an object of the present invention to provide a lighting fixture and method utilizing multiple reflections.

Another object of the invention is to provide a lighting fixture and method of the above character in which a substantial proportion of the light rays from the light fixture are emitted at a high angle.

Another object of the invenion is to provide a lighting fixture of the above character which utilizes an enclosure having anti-reflection coatings thereon.

Another object of the invention is to provide a lighting fixture of the above character which makes it possible to increase the coefficient of utilization.

Another object of the present invention is to provide a lighting fixture and method of the above character which provides improved light distribution.

Another object of the invention is to provide a lighting fixture and method of the above character which has low glare.

Additional objects and features of the invention will appear from the following description which the preferred embodiments set forth in detail in conjunction with the accompanying drawings.

DESCRIPTION OF THE PREFERRED EMBODIMENTS

Figure 1:
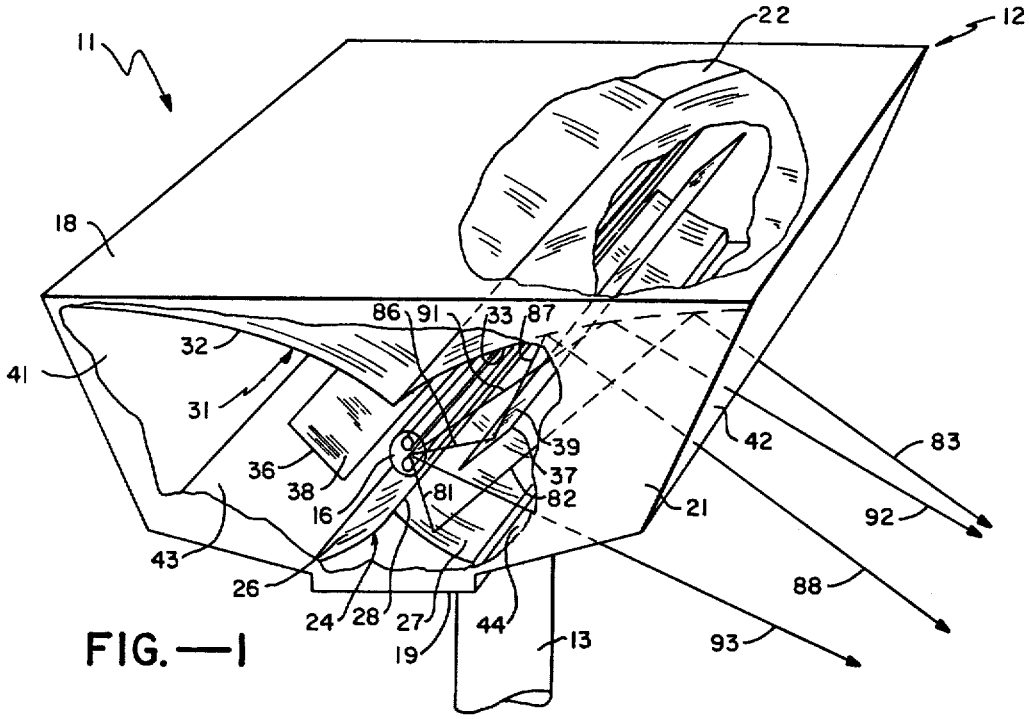
FIG. 1 is an isometric view with certain portions broken away showing a lighting fixture incorporating the present invention.

In FIG. 1 there is shown a lighting fixture or luminaire 11 which incorporates the present invention. The lighting fixture or luminaire 11 consists of a housing 12 which is supported in a suitable manner such as by mounting the same upon a pole 13. The housing 12 is provided with open sides and an open bottom. The lamp 16 of a suitabe type such a low pressure sodium source is disposed within the housing and is mounted in a socket (not shown) carried by the housing. As can be seen, the lamp 16 is in the form of a long cylinder and provides a linear light source which supplies light rays which emanate therefrom through the sides and bottom of the fixture as hereinafter described.

The housing 12 consists of a planar top wall of a suitable opaque material such as metal. A bottom support plate 19 is mounted upon the pole 13. Side plates 21 and 22 are mounted upon the support plate 19. The side plates 21 and 22 are spaced in parallel and are secured to the planar top wall 18. The side plates 21 and 22 are formed of a suitable material such as metal. As will be noted, the support plates 19 extend longitudinally of the housing 12 and underlie the lamp 16.

A bottom reflector 24 is mounted upon the support plate 19 and extends longitudinally of the support plate and underlies the lamp 16. The reflector is provided with two curved surfaces 26 and 27 which form first light reflecting surfaces. As will be noted, the surfaces 26 and 27 are slightly concave and meet along a line 28 which form the apex of a triangle when the reflector 24 is viewed in cross-section.

A top reflector 31 is provided which is carried by the housing and has curved reflecting surfaces 32 and 33 which join along a line 34 extending longitudinally of the lamp 16 and overlying the lamp 16. The reflecting surfaces 32 and 33 form second light reflecting surfaces as hereinafter described.

The bottom and top reflectors 24 and 31 can be formed of a suitable material such as specular aluminum which has been coated with reflection enhancing layers and then cut and bent to the desired configuration. The curvatures provided in the bottom surfaces 26 and 27 and the top surfaces 32 and 33 are taken from a parabola.

Intermediate or third reflectors 36 and 37 are provided and are secured to the end plates 21 and 22. The third reflectors 36 and 37 are provided with reflecting surfaces 38 and 39. As can be seen, the third reflectors 36 and 37 are disposed between the top and bottom reflectors. The surfaces 33, 38 and 39 can be planar or if desired can have a slight curvature and in fact can be parabolic or spherical depending upon the characteristics desired.

Means is provided for enclosing the sides and the bottom of the housing 12 and include side plates 41 and 42 which are mounted between top plate 18 and the end plates 21 and 22. As will be noted, the side plates 41 and 42 are inclined downwardly and inwardly at a slight angle. The bottom is closed by bottom plates 43 and 44. The side plates 41 and 42 and the bottom plates 43 and 44 can be formed of a suitable material such as glass. If desired, the inner and outer surfaces of the side plates 41 and 44 and bottom plates 43 and 44 can be coated with a suitable anti-reflection coating such as that disclosed in copending application Ser. No. 709,413 filed July 28, 1976. It will be noted that the lighting fixture shown in FIG. 1 has been designed to accommodate the line type of light source. A metal halide or high pressure sodium lamp can be used in a horizontal position in the luminaire shown in FIG. 1. Such a light source can also be used in a luminaire having a circular configuration such as shown in FIG. 2.

Figure 2:
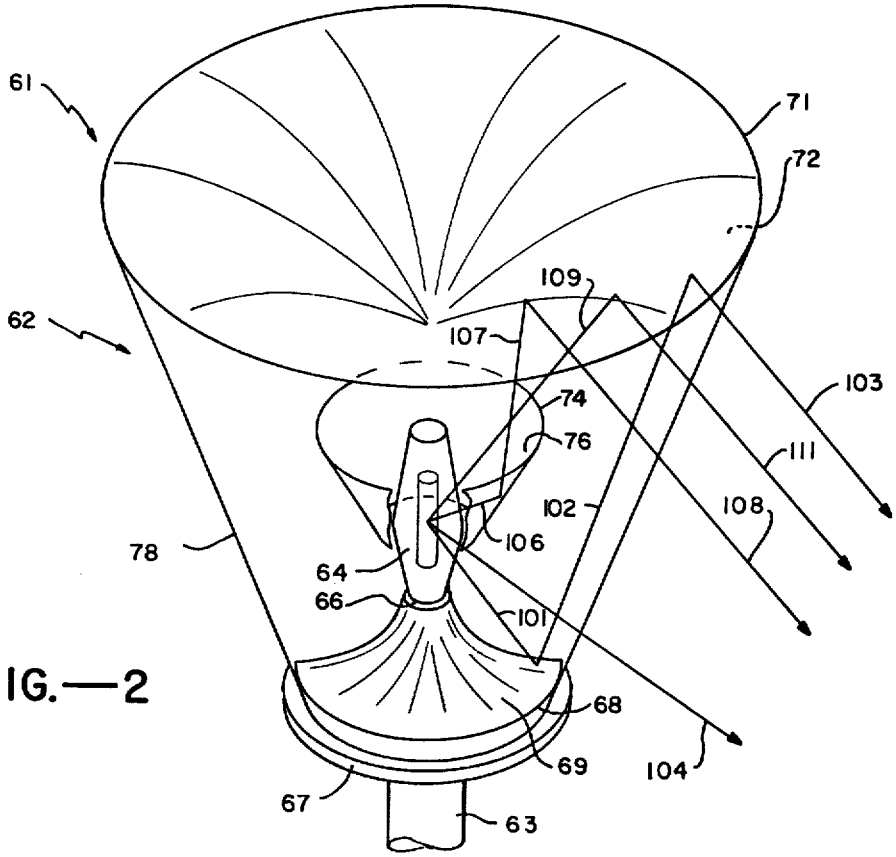
FIG. 2 is an isometric view of another embodiment of a lighting fixture incorporating the present invention.

The lighting fixture or luminaire 61 shown in FIG. 2 consists of a housing 62 which is mounted upon a support pole 63. The housing 62 is generally in the shape of an inverted truncated cone and has a generally vertical inclined opening through which rays of light produced by a lamp 64 can pass. The lamp 64 can be of a suitable type such as a high pressure sodium or a metal halide lamp. The lamp 64 extends in a generally vertical direction and is mounted in a socket 66 carried by a support plate 67 forming a part of the housing and mounted upon the pole 63. The bottom circular reflector 68 is mounted upon the support plate 67 and encircles or surrounds the lower extremity of the lamp 64. The bottom reflector 68 is provided with a curved surface 69 which has a generally parabolic configuration and which is adapted to receive low angle direct light rays from the lamp 64. These light rays are adapted to be reflected upwardly and onto a second or top reflector 71.

The reflector 71 has a circular configuration and has its center point overlying the center of the lamp 64. The reflector 71 is provided with a curved reflecting surface 72 which is formed as a paraboloid of revolution as shown in FIG. 2.

An intermediate or third reflector 74 is also provided which is in the form of a truncated inverted cone which encircles or surrounds the lamp 64 and has its lower extremity slightly below the midpoint of the lamp. The intermediate reflector 74 is provided with a conical surface 76 which surrounds the lamp and is adapted to receive direct rays from the middle and upper portions of the lamp and to reflect them upwardly toward the second reflector 71. The reflectors 71 and 74 can be supported in a suitable manner. For example, if the sides are not be enclosed, the reflectors 71 and 74 can be supported with small brackets (not shown) mounted upon the support plate 67. Alternatively, if desired, when the lamp is to be totally enclosed, an inverted truncated cone-shaped glass enclosure 78 can be provided which has its lower extremity seated upon the support plate 67 and which has its upper extremity or side covered by the top reflector 71. In such a construction, the intermediate reflector 74 can be supported by small brackets (not shown) mounted upon the support plate 67.

The surfaces 69, 72 and 76 of the first second and third reflectors are preferably coated with a suitable high reflectivity coating as hereinafter described.

Operation and use of the lighting fixtures or luminaires 11 and 61 shown in FIGS. 1 and 2 may now be briefly described as follows. First examining the lighting fixture shown in FIG. 1 it can be seen that direct light rays which are at small angles with respect to the vertical or normal will strike the first reflector surfaces 26 and 27 as represented by the ray 81 and will be reflected upwardly as represented by the ray 82 to strike the reflecting surfaces 32 and 33 of the top reflector 31 and thence will be reflected through the glass side plate 42 at a high angle with respect to the vertical as represented by the ray 83.

Direct light beams from the lamp 16 at an intermediate angle with respect to the vertical or normal as represented by the ray 86 will strike the reflecting surfaces 38 and 39 and will be reflected therefrom as represented by the ray 87 to the reflecting surfaces 32 and 33 of the top reflector 31 and thence will be reflected outwardly through the side opening and through the glass enclosures 41 and 42 as represented by the ray 88 at a high angle with respect to the vertical i.e. in the vicinity of 70° and greater from normal. Direct light beams from the lamp 16 at a very high angle as represented by the ray 91 will strike the reflecting surfaces 32 and 33 of the top reflector and will be reflected outwardly through the side glass plates 41 and 42 at a high angle as represented by the ray 92.

Certain of the light beams from the lamp 16 will have a sufficiently high angle and can pass through the bottom and side walls 41, 42 and 43 and 44 without striking either the intermediate reflector 36 or the top reflector 31 as represented by the ray 93. With respect to the light beams represented by the rays 83, 88 and 92, it can be seen that prior to the light beams emerging as these rays, the light beams have been reflected by two reflecting surfaces. It can be seen by utilizing these two reflecting surfaces that it is possible to achieve a large concentration of the light from the light fixture at a high angle as for example from 65° to 75°.

The pattern of reflection from the fixture shown in FIG. 2 is similar to that shown in FIG. 1. For example, direct light beams emanating from the source 64 and extending downwardly at a small angle from the vertical would strike the surface as represented by the ray 101 and would be reflected by the surface 69 upwardly as represented by the ray 102 and will strike the surface 72 of the top reflector and will be reflected outwardly through the side at a high angle as represented by the ray 103. Direct rays emanating from the lamp 64 at a high angle as for example angles in the vicintiy of 70° would pass directly through from the lamp and would miss the bottom reflector 68 and would pass through the glass enclosure 78 as represented by the ray 104. Direct rays from the lamp coming off at still higher angles as represented by the ray 106 would strike the reflecting surface 76 of the intermediate reflector 74 and would be reflected upwardly as represented by the ray 107 onto the reflecting surface 72 of the top reflector 71 and then would be reflected outwardly through inner glass enclosure 78 as represented by the ray 108. Light coming off at a still higher angle from the lamp 64 is represented by the ray 109 would miss the intermediate reflector 74 and would strike the reflecting surface 72 of the top reflector 71 and be reflected therefrom through the glass enclosure 78 at a high angle as represented by the ray 111.

From the ray diagram, it again can be seen that with the lighting fixture shown in FIG. 2 with the use of multi-reflections it is possible to direct the light from the lamp 64 in such a manner so that a very substantial portion of light emitted from the fixture is at a high angle as for example in the vicinity of 70° and higher from the vertical or normal. Such a result is highly desirable because it makes it possible to adequately light the area most remote from the lighting fixture of the area which would be covered by the lighting fixture. The remainder of the area in closer vicinity to the pole of the lighting fixture would be illuminated from scattered light emitted from the lighting fixture. With the lighting fixture shown in FIG. 1, most of the light would be directed in two directions from the lighting fixture whereas in the lighting fixture shown in FIG. 2, the light would be radiated at all compass directions equally but with most of the radiation being at a substantial angle from the normal and the vertical as for example 70° to 75°.

Figure 3:
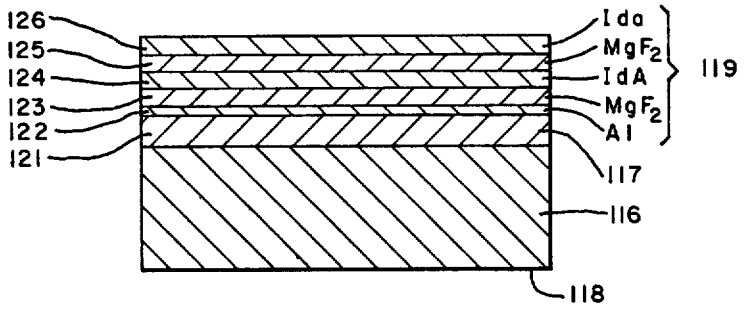
FIG. 3 is a cross-sectional view of a metal reflector having a high reflecting coating thereon for use in the lighting fixtures shown in FIGS. 1 and 2.

In conjunction with the lighting fixture shown in FIGS. 1 and 2, it is desirable to optimize as much as possible the reflectivity from the surfaces which reflect light from the lighting fixture. In FIG. 3, there is shown a design of a coating which has been optimized for use with high pressure or low pressure sodium lamps. As shown therein, the reflector is represented by a substrate 116 formed of a suitable material such as aluminum having first and second surfaces 117 and 118.

The surface 117 of the aluminum reflector is prepared in a conventional manner to provide a highly polished surface as for example by an etch process well known to those skilled in the art. Thereafter, a protective layer or coat 121 is provided on the surface 117. It is formed of a specular aluminum material which is usually aluminum oxide that serves to protect the highly polished surface 117. This layer 121 is relatively thick as for example two microns or greater. An aluminum layer 122 is then deposited on the protective layer 121 in a suitable manner such as by evaportation to a thickness ranging from 300 to 1,000 Angstroms and preferably a thickness of approximately 600 Angstroms. A layer 123 deposited on the aluminum layer 122 is a layer formed of a low index material as for example magnesium fluoride having an index of refraction of 1.38 and a thickness of 4880 Angstroms. The layer is normally designed for a quarter wave optical thickness at the design wave length of 589 nanometers which is the region of maxium light emission from low pressure and high pressure sodium lamps. The layer, however, has been optimized and is slightly thinner to take care of some phase angle shift caused by the aluminum layer 122. The next layer 124 is formed of a suitable high index material having an index of refraction in the range of 1.9 to 2.3. One material found to be particularly satisfactory is a material described in U.S. Pat. No. 3,034,924 hereinafter identified as "Ida" having an index of refraction of approximately 2.06. The layer 124 is formed to a thickness of 5880 Angstroms. The layer 125 is formed of the low index material magnesium fluoride to a thickness of 5880 Angstroms and the layer or outer layer 126 is formed of Ida to an optical thickness of 5880 Angstroms. It should be appreciated with respect to the thicknesses hereinbefore identified with respect to the layers 123 through 126 that their thicknesses can be varied within plus or minus 15% and still achieve satisfactory results. All of the layers have been designed for the design wave length of 589 nanometers associated with sodium.

It also should be appreciated in connection with the foregoing, other combinations of low and high index materials can be utilized. For example, zirconium oxide with an index of refraction of 2.00 could be utilized as another high index material with magnesium flouride as a low index material with the same respective thicknesses as given above. Also titanium dioxide with an index of refraction of 2.31 can be used as the high index material and silicon dioxide with an index of refraction of 1.45 can be used as the low index material with the same respective thicknesses.

Figure 4:
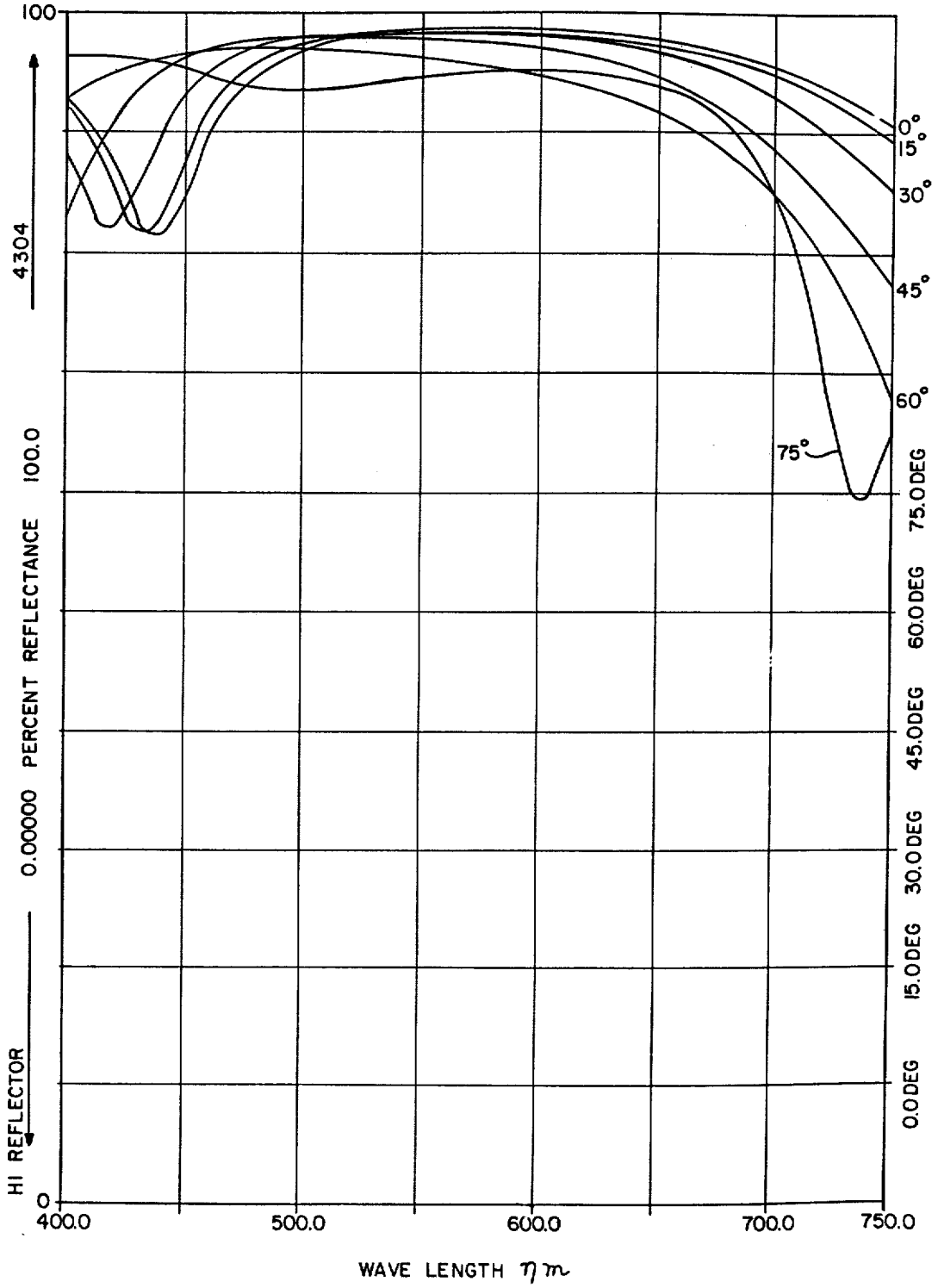
FIG. 4 is a graph showing the reflectance with wave length of the coating shown in FIG. 3.

In FIG. 4 there is shown a graph of the reflectance which can be obtained with the coating 119 shown in FIG. 3 with respect to wave length. The performance of the coating for light striking it at different angles is shown by the curves in FIG. 4 which have the different angles of light identifying the various curves. It can be seen from the graph that at 589 nanometers the reflectivity provided by the coating is very high and for most of the light it is in the vicinity of 98%. The reflectivity at 0, 15, 30, 45, 60 and 75 degree angles of incidence is shown. The significant fact which can be ascertained from FIG. 4 is that the reflectivity of the coating is excellent for angles of incidence at the center of reflectivity for the high pressure or low pressure sodium i.e. 589 nanometers in that it never falls below 95% and goes to 98% at the lower angles.

Figure 5:
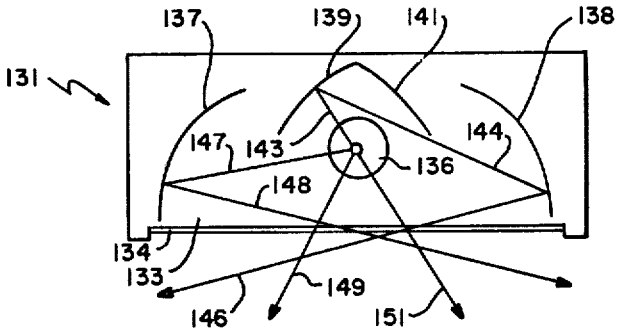
FIG. 5 is a schematic diagram of another embodiment of a lighting fixture incorporating the present invention.

In FIG. 5, there is shown a cross-sectional view in schematic form of a sharp cut-off lighting fixture or luminaire 131. It consists of a housing 132 which has a generally box-like configuration and which has an open lower side 133. As shown, the lower side 133 can be closed by a glass plate or enclosure 134 which is provided with suitable anti-reflection coatings on both surfaces of the same. A lamp 136 similar to the lamp 16 shown in FIG. 1 is mounted within the housing 132 by a socket (not shown) which is carried by the housing. A pair of curved, spaced reflectors 137 and 138 are mounted within the housing and have curved surfaces which face the lamp 136. A pair of additional top curved reflectors 139 and 141 are mounted within the fixture and generally overlie the lamp 136 as shown in FIG. 5. By properly positioning the reflectors 137, 138, 139 and 141 and by the use of a double reflection, it is possible to greatly increase the amount of light which is emitted from the fixture at a high angle as for example in excess of 70° from normal. As can be seen, the direct light from the lamp 136 which is emitted in an upward direction in the fixture as shown by the ray 143 will strike the reflector 139 and be reflected therefrom as represented by the ray 144 to the opposite side reflector 138 and be reflected therefrom as represented by the ray 146 at a very high angle as for example, angles in excess of approximately 70° and greater from normal. Other direct rays from the lamp 136 are represented by the ray 147 will be reflected by the side reflectors 137 and 138 as shown by a ray 148 and pass through the glass enclosure 134 at a high angle. Other light from the lamp 136 is represented by the rays 149 and 151 and will pass directly downwardly through the glass enclosure 134 and will cover the area not covered by the high angle rays hereinbefore described. From the foregoing, it can be seen by the use of the double reflections, it is possible to substantially increase the amount of light which is being emitted from the lighting fixture 131 at a high angle.

Figure 6:
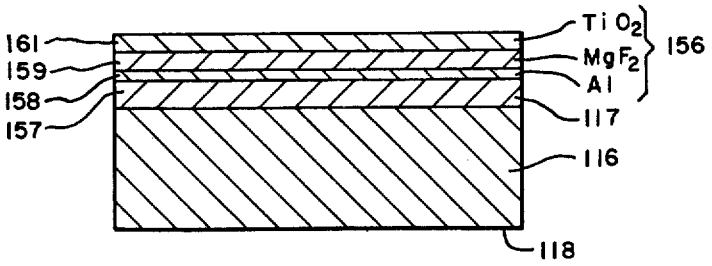
FIG. 6 is a cross-sectional view of metal reflector with the high reflecting coating thereon which is less complex than that shown in FIG. 3.

In FIG. 6 there is shown a cross-sectional view of a simpler coating than that shown in FIG. 3. The coating 156 consists of two layers rather than four layers on the aluminum layer. As with the embodiment shown in FIG. 4, the aluminum base metal 116 has a protective coating 157 formed on the surface 117. The layer 157 is formed of aluminum oxide in the same manner as the layer 121 in FIG. 3. A 600 Angstrom aluminum layer 158 is then formed on the protective layer 157 also in the same manner as hereinbefore described in conjunction with FIG. 3. The next layer 159 is formed of magnesium fluoride having an index of refraction of 1.38 and having a quarter wave optical thickness for the design wave length of 589 nanometers. The next layer 161 is formed of a high index material such as titanium dioxide having an index of refraction of 2.31 and a quarter wave optical thickness for the design wave length of 589 nanometers.

Figure 7:
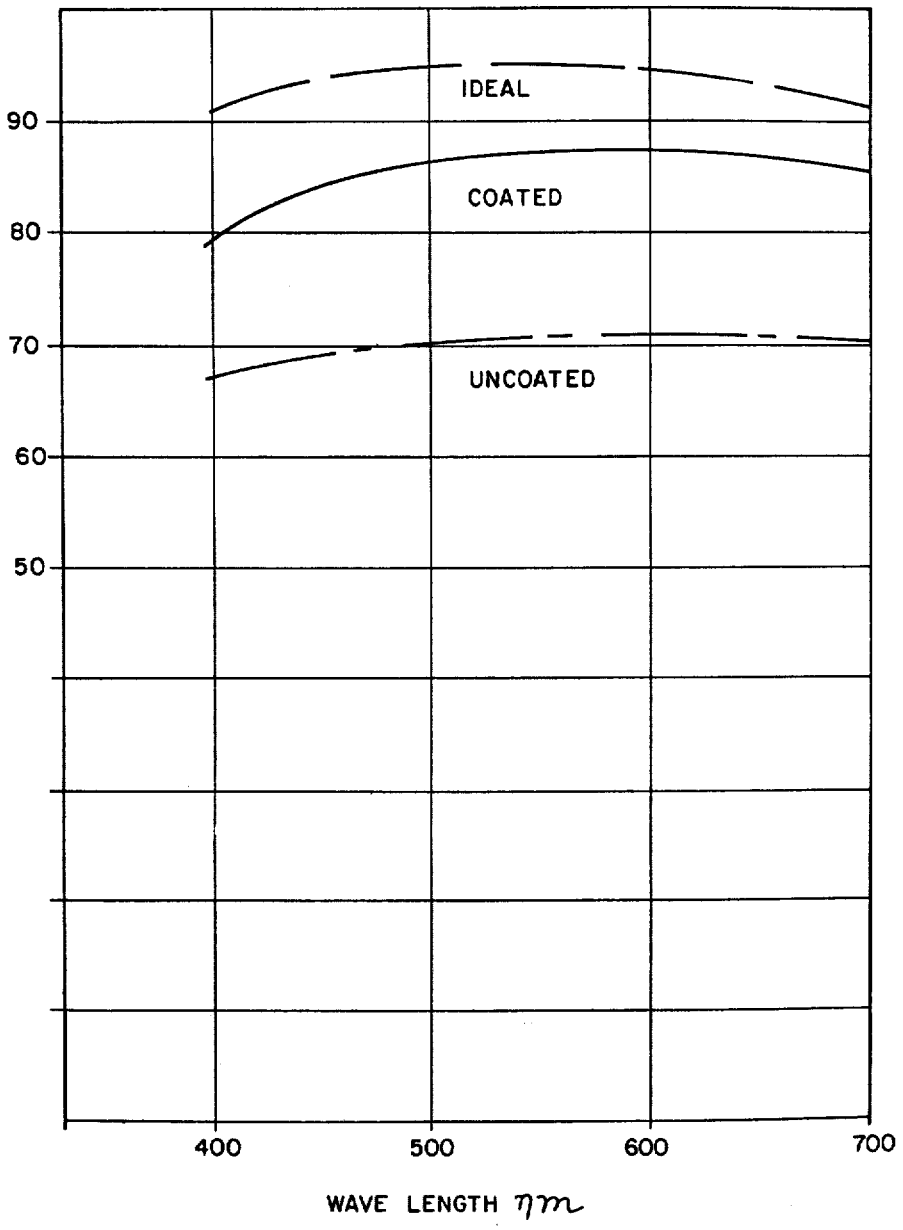
FIG. 7 is a graph showing the reflectivity with wave length of the coating shown in FIG. 6.

In FIG. 7, there is shown a graph which gives the reflectivity of the coating 156 shown in FIG. 6. As will be noted, there are three curves shown in FIG. 7, one uncoated, the other coated and the other one ideal. The first curve, the uncoated curve, gives the reflectivity for a piece of spectral aluminum normally used in lighting fixtures. This spectral aluminum which was tested is identified by the trade name Alzak which is an aluminum which is chemically polished and provided with a protective coating. As will be noted, this material had a reflectivity of approximately 70%. By coating the same with a coating 156 of the type shown in FIG. 7, it is possible to increase the reflectivity to approximately 87% at the major region of interest i.e. 589 nanometers. It was not possible to reach the ideal reflectivity because of surface scattering. Such scattered light is not lost but will be reflected usually in a cosine distribution and not at the high angle directions desired.

It is apparent from the foregoing that there has been provided a lighting fixture in which the light is reflected twice to increase the amount of light which is reflected at a high angle from the lighting fixture. By utilizing high reflectance coatings on the reflectors, it is possible to increase the coefficient of utilization of the lighting fixture. Since the loss is very low from the high reflecting surfaces of the reflectors, it is possible to use two or more reflections without unduly impairing the coefficient of utilization for the lighting fixture. This makes possible the improved distribution of light at the high angles while at the same time giving low glare. The low glare feature is obtained because most of the direct light emanating from the fixture has been redirected so that it will be emitted from the light fixture at high angles.

In connection with the reflectors provided in the lighting fixtures, the coatings can be formed on sheets of metal and thereafter the metal can be cut to size and bent into the desired configuration. By way of example, the coatings can be protected by an adhesive paper vinyl or the like which can after the material has been cut and bent into shape be removed to expose the coating. The coatings hereinbefore described are rugged and durable and can withstand this type of use. By designing the reflectors so that they are highly reflective at 589 nanometers, the wave length of low and high pressure sodium, the light fixtures can be designed to provide a very efficient luminaire having a large percentage of its light being directed at high angles and having a low amount of glare.

We claim:

1. In a method for producing light at a high angle from a lighting fixture with an open side and having a lamp therein, providing first and second reflectors having a metal layer and a multi layer high reflectivity coating carried on the metal layer and formed of materials having high and low indices of refraction to provide a reflectivity which does not fall below 95% for any light angle positioning said first and second reflectors on opposite ends of the lamp so that direct rays from the lamp are reflected by the first reflector to the second reflector and so that light impinging on the second reflector is reflected through the open side at a high angle of 70° and greater with respect to vertical and thereby reducing the quantity of direct light from the light fixture and increasing the light emitted from the lighting fixture at the high angle so as to reduce glare from the lighting fixture.

2. A method as in claim 1 together with providing an intermediate reflector and using the intermediate reflector for reflecting direct rays of light from the lamp and for reflecting the same onto the second reflector and thence from the lighting fixture at the high angle.

* * * * *